United States Patent [19]

Brown, III et al.

[11] 3,996,908

[45] Dec. 14, 1976

[54] FUEL SHUT-OFF VALVE ASSEMBLY

[75] Inventors: Reed M. Brown, III, Fairport; Earl R. Fischer, Rochester, both of N.Y.

[73] Assignee: General Motors Corporation, Detroit, Mich.

[22] Filed: Feb. 21, 1975

[21] Appl. No.: 551,605

[52] U.S. Cl. ..... 123/124 B; 261/DIG. 19; 261/DIG. 74; 123/97 B; 123/198 DB

[51] Int. Cl.[2] ..... F02M 7/12

[58] Field of Search ..... 261/DIG. 19, DIG. 74; 123/97 B, 124, 198 DB, 124 B; 251/122

[56] References Cited

UNITED STATES PATENTS

| | | | |
|---|---|---|---|
| 2,655,041 | 10/1953 | Jacobson | 251/122 X |
| 2,685,294 | 8/1954 | Gold et al. | 251/122 X |
| 2,886,020 | 5/1959 | Wolfe | 261/DIG. 19 |
| 2,895,561 | 7/1959 | McCollough | 180/82 |
| 3,042,387 | 7/1962 | King | 261/DIG. 19 |
| 3,365,166 | 1/1968 | Smith | 251/122 X |
| 3,414,244 | 12/1968 | Patterson | 251/122 X |
| 3,741,188 | 6/1973 | Rickey | 123/198 DB |
| 3,831,900 | 8/1974 | Matousek et al. | 251/122 |

*Primary Examiner*—Charles J. Myhre
*Assistant Examiner*—William C. Anderson
*Attorney, Agent, or Firm*—C. K. Veenstra

[57] ABSTRACT

In an internal combustion engine carburetor the idle mixture adjusting valve has a tapered metering portion disposed in the idle fuel discharge orifice and a separate closure portion engageable with a seat. A solenoid energized during deceleration moves the valve to engage the closure portion with the seat and interrupt fuel flow through the discharge orifice.

2 Claims, 3 Drawing Figures

FUEL SHUT-OFF VALVE ASSEMBLY

This invention relates to a fuel shut-off valve assembly which may be used in an internal combustion engine carburetor to interrupt flow through a fuel passage and, more particularly, to such a valve assembly which may interrupt fuel flow through the idle fuel discharge port during deceleration.

There have been numerous proposals for mechanisms which shut off fuel flow to the idle fuel discharge orifice during deceleration. For example, in U.S. Pat. No. 2,895,561 a solenoid operated valve blocks the idle fuel passage some distance above the idle fuel discharge port; in carburetors of current design, however, it is frequently difficult to install such a valve in that location. In U.S. Pat. No. 2,886,020 the idle mixture adjustment valve is itself operated by a solenoid to shut off fuel flow through the idle fuel discharge port; however that arrangement can only result in wear of the tapered metering portion of the adjustment valve and of the discharge port and thus in an increase in idle fuel flow.

This invention provides a fuel shut-off valve assembly which may be installed at the idle fuel discharge port and in which the valve and its associated seat are separate from the tapered metering portion of the adjustment valve and the discharge orifice.

The details as well as other features and advantages of this invention are set forth in the following detailed description and shown in the accompanying drawings wherein.

Figure 1:
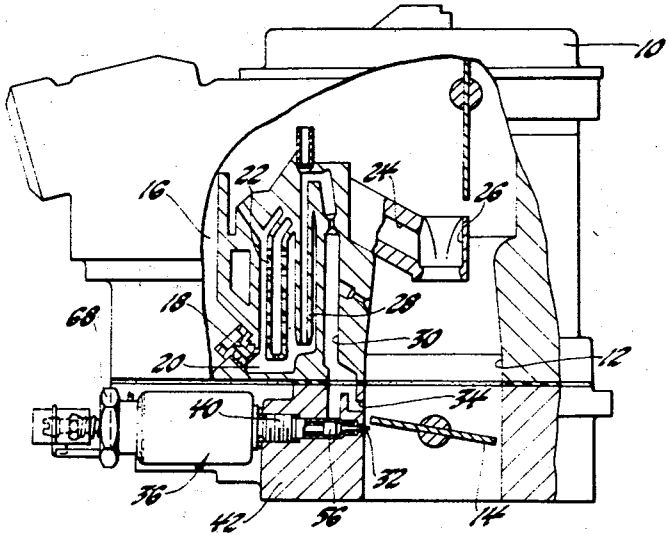
FIG. 1 is a side elevational view of a carburetor incorporating this shut-off valve assembly and in which parts of the carburetor have been broken away to schematically illustrate the idle fuel passage.

Referring first to FIG. 1, a carburetor 10 has a mixture conduit 12 containing a throttle 14 controlling flow therethrough. A fuel bowl 16 supplies fuel through a main metering jet 18, a main well 20, and a main well tube 22 to a mixture passage 24 which discharges into a venturi 26 disposed in conduit 12.

An idle pick-up tube 28 receives fuel from main well 20 and discharges it through a idle fuel passage 30 which opens into mixture conduit 12 through an idle fuel discharge port 32 and an off-idle port 34.

Figure 2:
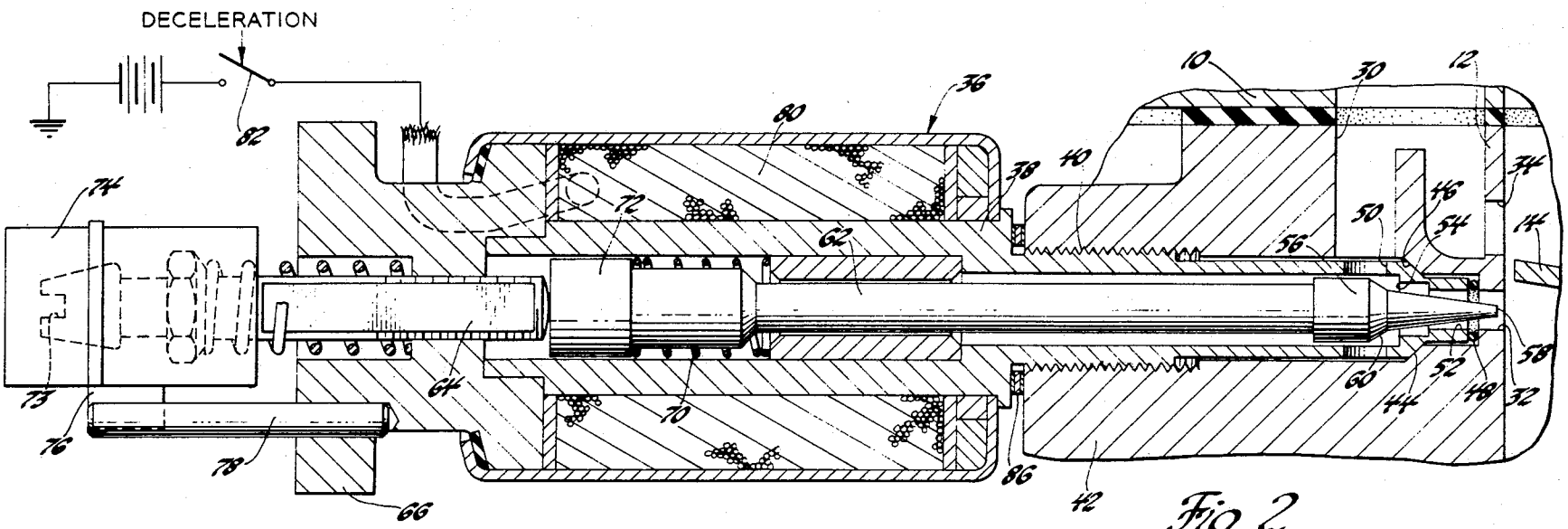
FIG. 2 is an enlarged sectional view of the shut-off valve assembly of FIG. 1 showing the details of its construction.

A fuel shut-off valve assembly 36 is disposed in passage 30 to control flow through discharge port 32. As shown in FIG. 2, assembly 36 includes a body 38 having threads 40 for securing assembly 36 to the throttle body 42 of carburetor 10. Body 38 is beveled near its right-hand end 44 to engage a shoulder 46 formed in idle fuel passage 30. An O-ring 48 seals against leaks between beveled portion 44 and shoulder 46.

Body 38 is hollowed to form a portion of idle fuel passage 30 and includes an inlet port 50, a discharge orifice 52, and an annular seat 54.

A valve member 56 is disposed within body 38. It includes a tapered metering portion 58 and a closure portion 60. A shank 62 is secured to valve member 56 and extends leftwardly toward an adjustable stop 64.

Stop 64 is carried in a head 66 which, as shown in FIG. 1, is provided with a hex 68 to receive a wrench for securing assembly 36 in throttle body 42.

A spring 70 biases the end 72 of shank 62 into engagement with stop 64 and thus disposes tapered metering portion 58 within discharge orifice 52. Stop 64 is threadedly received in head 66 and has a slot 73 to receive a driver for turning stop 64 so that the distance between stop 64 and orifice 52 may be varied; adjusting the position of stop 64 controls the disposition of tapered portion 58 in orifice 52 and thereby controls the idle fuel flow through discharge orifice 52 and port 32. If desired, stop 64 may carry a conventional idle adjustment limiter cap 74 which has an arm 76 engaging a pin 78 supported in head 66 to limit the adjustment of stop 64.

A coil 80 surrounds shank 62. When energized, such as through a switch 82, coil 80 moves shank 62 rightwardly against the bias of spring 70 to engage closure portion 60 against seat 54, thereby interrupting fuel flow through discharge orifice 52 and port 32.

Switch 82 may be closed during deceleration to interrupt fuel flow and thus reduce fuel consumption and, in some instances, the emission of undesirable exhaust gas constituents from the engine. Further, it will be appreciated that switch 82 also could be closed momentarily when the engine is stopped to interrupt fuel flow and thus inhibit dieseling or afterrunning of the engine. In addition, it will be understood that spring 70 could be deleted, that another spring could be used to bias valve member 56 into engagement with seat 54, and that coil 80 could be energized to move valve member 56 away from seat 54 whenever idle fuel flow is desired.

Figure 3:
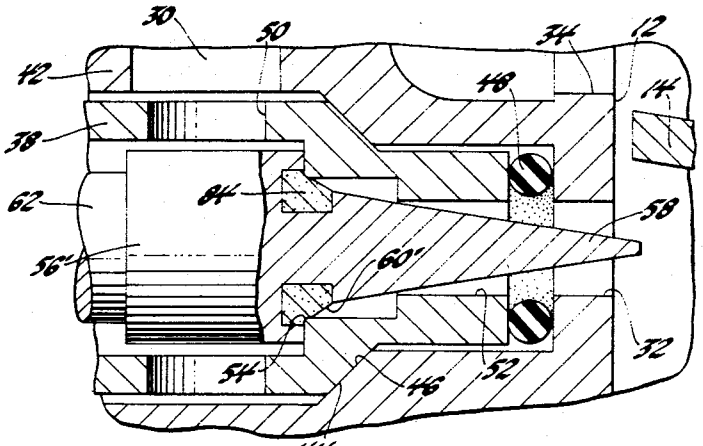
FIG. 3 is a view similar to a portion of FIG. 2 further enlarged to show an alternative construction for the valve member.

FIG. 3 illustrates a modified valve member 56' having an identical tapered metering portion 58 disposed within discharge orifice 52 and having a closure portion 60' which includes a Viton insert 84. Valve member 56' is shown with its closure portion 60' engaging seat 54, and it will be appreciated that in some applications Viton insert 84 may provide greater sealing and durability than the all-metallic closure portion 60 of valve member 56.

In each of these embodiments, it will be noted that the tapered metering portion of the valve member and the associated discharge orifice are separate from the closure portion and its seat. Thus the tapered metering portion does not engage the discharge orifice, and wear of those two components — with a concomitant change in idle mixture calibration — is precluded.

It also will be noted that shut-off valve assembly 36 is a compact unit carrying discharge orifice 52 and adjustable stop 64 as well as the closure and seat. This construction permits servicing of the shut-off and adjusting mechanisms as a unit. In addition, it permits body member 38 to be tightly secured to throttle body 42, compressing a gasket 86 therebetween to assure against leaks. It will be further appreciated, however, that the tapered metering portion 58 of valve member 56 may cooperate directly with discharge port 32 rather than with the separate discharge orifice 52 while maintaining all the benefits of this invention.

The embodiments of the invention in which an exclusive property or privilege is claimed are defined as follows:

1. A fuel shut-off valve assembly for use in an internal combustion engine carburetor having a fuel passage, said fuel shut-off valve assembly comprising a hollow body adapted to form a portion of said fuel passage and defining an orifice in said fuel passage and an annular seat in said fuel passage spaced from said orifice, a valve member disposed in said fuel passage within said hollow body and having a tapered metering portion disposed in said orifice and a closure portion engageable with said seat, a stop member carried by said body, said valve member further having a shank portion engageable with said stop member, means for operating said valve member to disengage said closure portion from said seat and to engage said shank portion with said stop member, said stop member being adjustable relative to said orifice to control the disposition of said tapered portion in said orifice and thereby control fuel flow through said orifice when engaged by said shank portion, and means for moving said valve member to disengage said shank portion from said stop member and to engage said closure portion with said seat to thereby reduce fuel flow through said passage, said body having means for securing said assembly to said carburetor.

2. A fuel shut-off valve assembly for use in an internal combustion engine carburetor having an induction passage for air flow to the engine, a throttle disposed in said induction passage for controlling flow therethrough, and a fuel passage opening into said induction passage downstream of said throttle, said fuel shut-off valve assembly comprising a hollow body adapted to form a portion of said passage and defining an orifice in said passage and a seat in said passage spaced from said orifice, a stop member disposed adjacent one end of said body and adjustable with respect to said orifice to vary the distance therebetween, a valve member disposed within said body and having a tapered metering portion disposed in said orifice, a closure portion engageable with said seat, and a shank portion engageable with said stop member, said valve member being reciprocable between a first position wherein said shank portion is disengaged from said stop member and said closure portion is engaged with said seat to reduce fuel flow through said passage and a said second position wherein said closure portion is disengaged from said seat and said shank portion is engaged with said stop member to locate said tapered metering portion at a desired position within said orifice and thereby control fuel flow through said orifice, spring means biasing said valve member to one of said positions, and a coil associated with said shank portion and energizable for moving said valve member from said one position to the other of said positions against the bias of said spring means, said body having means for securing said assembly to said carburetor.

* * * * *